United States Patent [19]

Kato

[11] Patent Number: 4,755,071

[45] Date of Patent: Jul. 5, 1988

[54] FRONT AND REAR PRINTER DEVICE WITH INK IMPREGNATED PLATEN

[75] Inventor: Kenji Kato, Tokyo, Japan

[73] Assignee: Janome Sewing Machine Co. Ltd., Tokto, Japan

[21] Appl. No.: 786,315

[22] Filed: Oct. 10, 1985

[30] Foreign Application Priority Data

Oct. 22, 1984 [JP] Japan ..... 59-220524

[51] Int. Cl.[4] ..... B41J 27/20

[52] U.S. Cl. ..... 400/188; 400/240.4; 400/470; 400/649; 400/662

[58] Field of Search ..... 400/124, 240, 240.4, 400/470, 471, 466, 498, 648, 649, 652, 82, 214, 662, 188

[56] References Cited

U.S. PATENT DOCUMENTS

| | | | |
|---|---|---|---|
| 1,836,906 | 12/1931 | Degener | 400/662 |
| 1,940,364 | 12/1933 | Miller | 400/498 |
| 2,244,095 | 6/1941 | Botham et al. | 400/662 |
| 2,703,836 | 3/1955 | Mirogue et al. | 400/662 |
| 2,858,004 | 10/1958 | Febvre | 400/662 |
| 4,533,267 | 8/1985 | Kurachi et al. | 400/214 |
| 4,543,001 | 9/1985 | Tanaka et al. | 400/240.4 |
| 4,556,333 | 12/1985 | Stefansson | 400/662 |
| 4,623,275 | 11/1986 | Hanyu et al. | 400/662 |

FOREIGN PATENT DOCUMENTS

| | | | |
|---|---|---|---|
| 2951069 | 7/1981 | Fed. Rep. of Germany | 400/188 |
| 128860 | 8/1983 | Japan | 400/188 |
| 35961 | 2/1984 | Japan | 400/662 |
| 83670 | 5/1984 | Japan | 400/188 |
| 768132 | 2/1957 | United Kingdom | 400/662 |

OTHER PUBLICATIONS

"Color Wheel w/Inked Platens", F. R. Humphreys; *IBM Tech. Disc. Bull.;* vol. 25, No. 4, p. 2193; Sep. 1982.

*Primary Examiner*—David Wiecking
*Attorney, Agent, or Firm*—Michael J. Striker

[57] ABSTRACT

According to the invention, printing is formed on a front surface of a printing paper by moving a printing ribbon in opposition to a wire of a printing head, and rotating a platen so as to face a solid part disposed in the platen to the wire printing head. On the other hand, the printing is subsequently carried out on a back surface of the printing paper by moving the printing ribbon to its retreating position, and rotating the platen so as to face an ink impregnated porous substances of the platen to the wire printing head.

12 Claims, 3 Drawing Sheets

FRONT AND REAR PRINTER DEVICE WITH INK IMPREGNATED PLATEN

FIELD OF THE INVENTION

The invention relates to an impact printer device, and more particularly to an impact printer device of a wire dot which uses a wire as a letter forming element.

BACKGROUND OF THE INVENTION

Recently, various kinds of printers have been developed and reduced to practice as output devices of computers or printing devices of word processors, and they have contributed to developments of office automations.

The impact printer of a wire dot system uses the wire as the letter forming element for performing printings on a printing paper by selectively striking a platen via an ink ribbon and the printing paper by means of said wire, and has been widely spread, since it is of small size and cheap, and can print many letters, marks, devices and others.

PROBLEMS TO BE SOLVED BY THE INVENTION

Conventional printers, including the impact printer of the wire dot system, form prints only on one side of the printing paper. In this regard, there have been problems about in reducing the amount of the printed papers, or in handling and storing documents having many pages or an increased number of sheets of papers. In order to solve such problems, it has been necessary to produce printings on both sides of the printing paper.

However, the foregoing printings on the both sides of the paper depend upon a method in which the paper which has been once charged for printing thereon, is again charged by the printer device for printing on a back side of said paper. This method takes much handling and is only applied to a single slip.

Further, with such a printer device it has been found that the outer surface of the paper is printed, and the printing paper is reversely rotated and again introduced to a printing section for printing on the back side of the paper. But since the paper is reversely rotated, the mechanism is complicated and may be only applied to the single slip. Therefore it has not yet been actually practiced.

SUMMARY OF THE INVENTION

In view of the above mentioned circumstances, the present invention has been devised to enable printing on both sides of the printing paper not only in the single slip but also in a continuous sheet.

BRIEF DESCRIPTION OF THE INVENTION

The invention is a printer device which is characterized by comprising a platen composed of ink impregnated porous substances and a solid part which are rotatably mounted on a platen shaft, a wire printing head in opposition to said platen and disposed slidably in parallel to the platen shaft, a printing paper placed in a space defined between the platen and the wire printing head for moving in a perpendicular direction with respect to the platen shaft, and printing ribbon disposed in said space for moving between a position opposite the wire of the printing head and a position retreating therefrom.

According to the invention, the printing is at first carried out on the upper surface of the paper by moving the printing ribbon opposite the wire of the printing head, and rotating the platen so as to face the solid part of the platen to the wire printing head. On the other hand, the printing is subsequently carried out on the back surface of the paper by moving the printing ribbon to its retreating position, and rotating the platen so as to face the ink impregnated porous substances to the wire printing head.

DETAILED DESCRIPTION OF PREFERRED EMBODIMENT OF THE INVENTION

Figure 1:
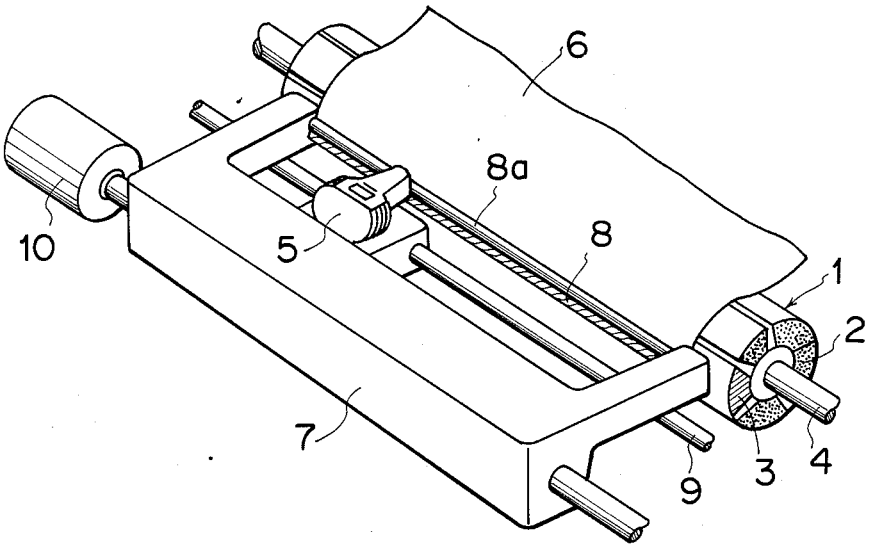
FIG. 1 is a perspective view showing an embodiment of the invention.

A platen 1 is composed of ink impregnated porous substances 2 and a solid part 3, and is rotatably mounted on a platen shaft 4 which is secured to a base frame (not shown).

The ink impregnated porous substance 2 is produced by impregnating the ink into, e.g., sintered Nylon. The solid part 3 is provided by a rubber of hard property, plastics or metal.

Figure 3:
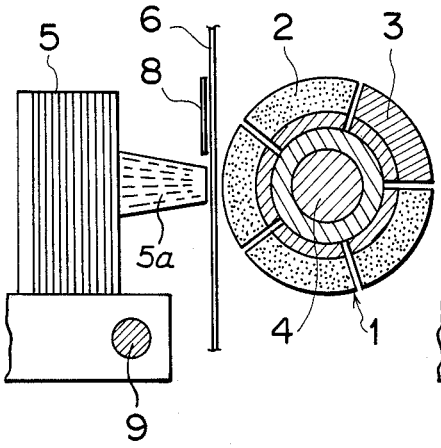
FIGS. 2 and 3 are side cross sectional views of the above.
Figure 2:
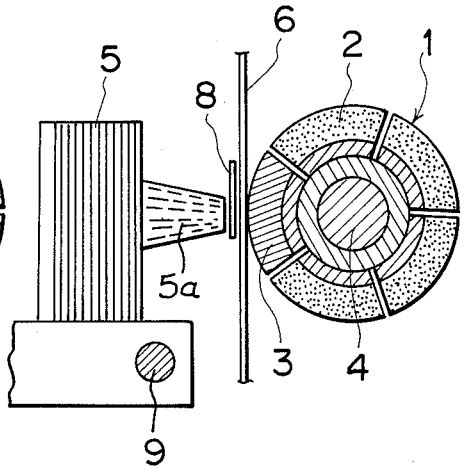

FIGS. 2 and 3 illustrate the ink impregnated porous substance 2 of four colors, and of course the embodiment of the invention is not limited to this shown one, but the ink impregnated porous substances may have optional numbers of the colors.

The wire printing head 5 with printing wires **5*a* is slidably disposed on a guide shaft 9 in parallel to the platen 1. Between the platen 1 and the wire printing head 5 the printing paper 6 is placed and fed in right angled direction with respect to the platen shaft 4**.

A printing ribbon 8 is housed in a ribbon cassette 7 and is positioned between the printing paper 6 and the wire printing head 5. The printing ribbon 8 is moved by rotation of the ribbon cassette 7 between the position opposing to the wire printing head 5 and the position retreating therefrom.

A white ribbon **8*a* containing no ink is provided in parallel to the printing ribbon 8. For carrying out the printing on the back side of the printing paper 6 by using the ink impregnated porous substance 2, if said white ribbon 8*a* is opposed to the wire of the printing head 5**, and therefore said back side may be prevented from ink stain.

The illustrated example uses a monochromatic printing ribbon, but a polychromatic printing ribbon may be used. In such a latter case, the printing ribbon is positioned by the motor 10, so that the ribbon of a selected color is opposed to the wire printing head 5, and the polychromatic printing can be performed. The positioning of the printing ribbon 8 depends upon the motor 10, but controlling of two positions may depend upon Solenoid.

The present invention will be explained in reference to FIGS. 2 and 3. FIG. 2 shows a condition that the printing ribbon 8 and the solid part 3 of the platen 1 are positioned in opposition to the wire printing head 5, and if the printing is carried out in this condition, the front surface of the printing paper is printed.

FIG. 3 shows a condition that the printing ribbon 8 is moved to its retreating position, and the ink impregnated porous substance 2 is positioned in opposition to the printing head 5, and if the printing is carried out in this condition, the back surface of the printing paper is printed. In this printing, if the white ribbon 8*a* is arranged with respect to the printing head 5, the upper surface of the printing paper may be prevented from the ink stain of the wire.

As mentioned above, the present invention enables not only the monochromatic printing, but also the polychromatic printing on the both sides of the printing paper 6.

The polychromatic printing is formed on the upper surface of the paper by opposing the desired color of the polychromatic ribbon 8 to the wire of the printing head 5.

On the other hand, the back surface of the paper 6 is effected with the polychromatic printing by mounting the polychromatic ink impregnated porous substance on the platen 1, and rotating the platen to the desired color with respect to the printing head 5.

Figure 4:
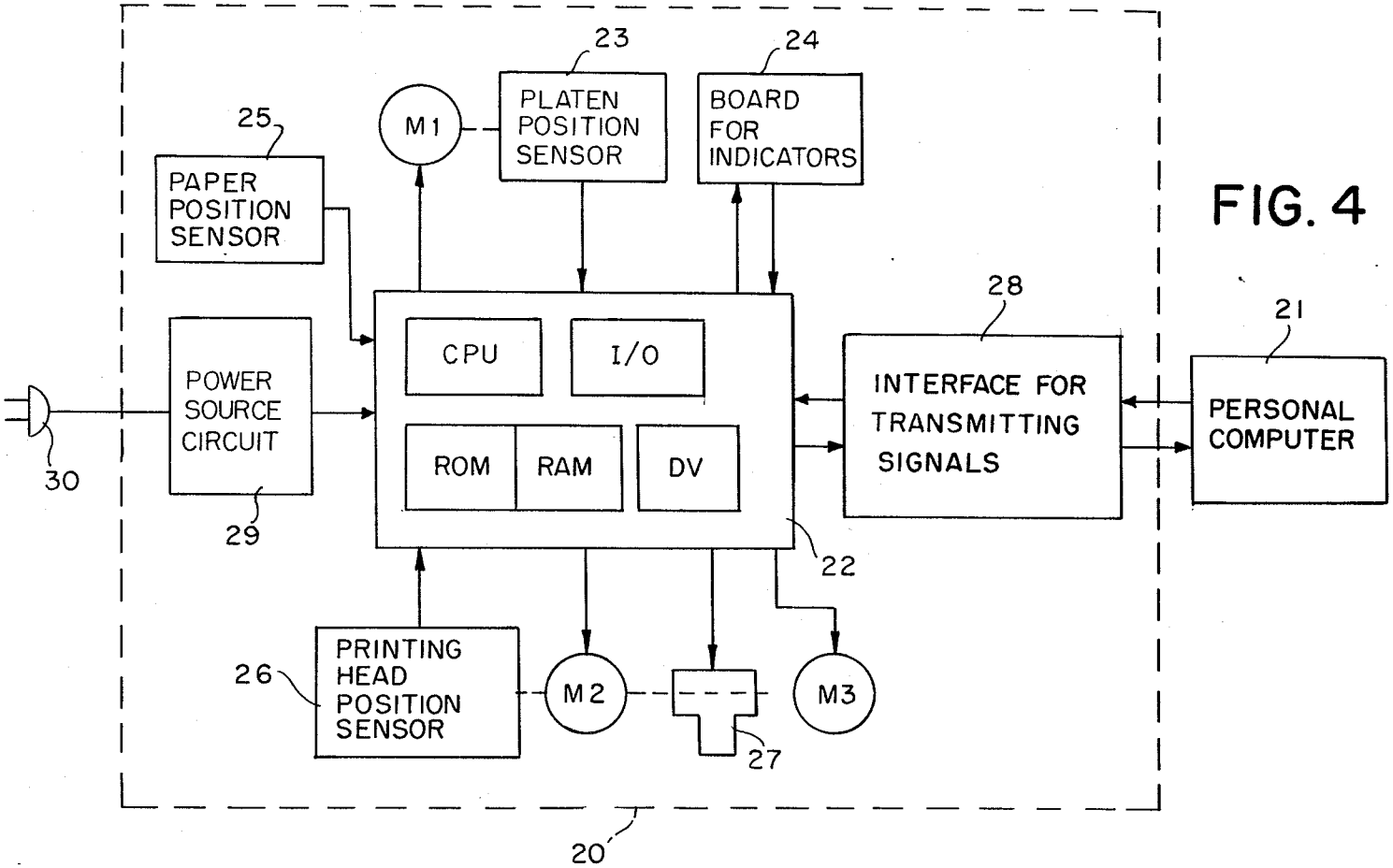
FIGS. 4 and 5 are a control block diagram.

A further explanation will be made to control of the printer system in reference to FIGS. 4 and 5. In FIG. 4, the numeral 20 is the printer device of the invention, 21 is a computer device such as a personal computer and 22 is a control circuit which includes therein a micro-computer composed of a central processing unit CPU, a read-only-memory ROM, a random-access-memory RAM and an input-output control device I/O, and a driver circuit DV and a mode switching circuit between one side printing and both side printing.

M1 is a stepping motor for feeding of the printing paper and positioning of rotation of the platen, 23 designates a sensor for detecting an initial position of the platen, 24 is a board for housing LED indicators and operation buttons, 25 is a sensor for detecting the printing paper, 26 is a sensor for setting initial position of the printing head, and 27 is the printing head.

M2 is a stepping motor for feeding of the printing head.

M3 is a motor for positioning the printing ribbon cassette, corresponding to the motor 10. 28 is an interface for transmitting signals between the printer 20 and the personal computer 21. 29 designates a power source circuit including a transformer and a constant-voltage circuit, 30 is a commercial AC power source.

Figure 5:
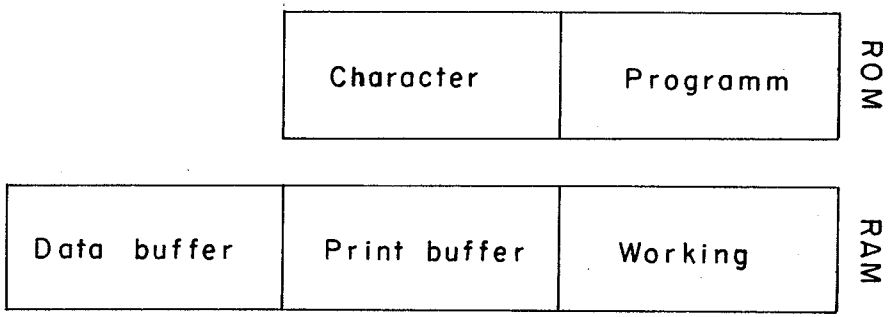

FIG. 5 is enlarged views of ROM and RAM of FIG. 4, and ROM includes a program part and a character part, and RAM a working part, a data buffer part and a printer buffer part.

The printer by the control part composed as mentioned above is controlled as under. Letter code by, for example, JIS code transmitted from the personal computer is housed in the data buffer part of RAM by, e.g., 2 pages.

The printer is controlled as follows by the controller composed as mentioned above. The letter codes by e.g., JIS code sent from the personal computer are stored in a data buffer part of RAM by, e.g., two page. Said letter codes are checked with letter data of a character part successively from an initial one of said letter codes, and are changed into letter data, and the letter data are stored in a print buffer part of RAM by, e.g., two pages. These letter data are printed on the upper surface of the paper by means of the printing ribbon, or printed on the back surface by means of the ink impregnated porous substances.

The printings on the both sides of the printing paper may depend on various kinds of the printing ways.

The whole upper surface is printed and the back side is printed thereafter; or after one passage is printed on the upper surface, one passage is printed; one passage is printed on the upper surface, and when returning, one passage is printed on the back side; or when the upper surface is finished, the printing on the back side is begun from the last line. These printings are started from the position where the data are picked up from the print buffer part of RAM.

What is claimed is:

1. A printer device for printing on both sides of a sheet of paper that uses an ink ribbon, the printer device comprising:

(a) platen means including a rotatable central shaft, a plurality of elongated porous elements impregnated with inks of different colors and at least one elongated solid element with no ink impregnated thereon, all of said porous elements and said solid element being removably attached around said rotatable shaft and spaced peripherally apart from each other;

(b) means for striking a selected one of said porous elements and said solid element through a paper to be printed and including a printing head arranged opposite said platen means, means for guiding said printing head and including a guide shaft arranged in parallel with said rotatable shaft of said platen means, said printing head being slidably movable on said guide shaft and having a plurality of printing wires, said printing wires being selectively driveable for striking a selected one of said porous elements and said solid element through the paper to be printed when the paper is located between said printing head and said platen means;

(c) means for printing on the front side of the paper by selectively driving said printing wires to strike said solid element through the paper and the ink ribbon, said printing means including means for moving the ink ribbon to an operative position; and (d) means for rear printing on a rear of the paper by selectively driving said printing wires through the paper, said rear means for printing including means for rotating said platen means to select one of said ink impregnated elements of said platen means and means for moving the ink ribbon to an inoperative position.

2. The printer device as defined in claim 1, further comprising:

the ink ribbon to be used;

cassette means containing the ink ribbon, the ink ribbon being extendable parallel to said rotatable shaft of said platen means, said moving means including means for moving said cassette and thereby said ink ribbon between said operative and inoperative positions.

3. A printer device for printing on both sides of a sheet of paper, comprising:

(a) platen means having a rotatable center shaft, a plurality of elongated porous elements impregnated with inks of different colors and at least one elongated solid element having no ink impregnated thereon, all of said porous elements and said solid element being removably attached around said rotatable center shaft and spaced peripherally apart from each other;

(b) a guide shaft arranged parallel with said rotatable shaft of said platen means;

(c) a printing head arranged opposite to said platen means and being slidably movable on said guide shaft, said printing head having a plurality of printing wires selectively driveable to strike a selected one of said ink impregnated elements of said platen means through a paper to be printed located between said printing head and said platen means to thereby transfer ink from said one of said selected ink impregnated elements to a rear side of the paper;

(d) an ink ribbon extended in parallel to said rotatable shaft of said platen means;

(e) cassette means containing said ink ribbon therein, said cassette means being arranged to provide said extended ink ribbon between said printing head and the paper to be printed;

(f) printing means for printing on a front side of the paper by selectively driving said printing wires to strike said solid element through the paper and said ink ribbon, said printing means including means for rotating said platen means to select the solid element of said platen means and cassette moving means for moving said cassette means to move said ink ribbon to an operative position; and (g) means for printing on the rear of the paper by selectively driving said printing wires to strike one of said ink impregnated elements through the paper and including means for rotating said platen means to select one of said ink impregnated elements of said platen means and means for moving said cassette means to an inoperative position.

4. The printer device as defined in claim 3, wherein said ink ribbon is monochromatic.

5. The printer device as defined in claim 3, wherein said ink ribbon is polychromatic.

6. The printer device as defined in claim 3, wherein said porous elements are made of sintered nylon.

7. The printer device as defined in claim 3, wherein said solid element is made of a hard rubber.

8. The printer device as defined in claim 3, wherein said solid element is made of a plastic.

9. The printer device as defined in claim 3, wherein said solid element is made of a metal.

10. The printer device as defined in claim 3, wherein said casette moving means includes a reversible motor.

11. The printer device as defined in claim 3, wherein said casette moving means includes a solenoid.

12. The printer device as defined in claim 3, further comprising:

a second ribbon (8*a*) having no ink impregnated thereon, said second ribbon (8*a*) being arranged adjacent to said ink ribbon and in parallel therewith and being movable in association with said ink ribbon so that said second ribbon is movable to said operative position when said cassette means and therefore said ink ribbon is moved to said inoperative position and vice versa.

* * * * *